US006249203B1

(12) United States Patent
Hanato et al.

(10) Patent No.: US 6,249,203 B1
(45) **Date of Patent: *Jun. 19, 2001**

(54) WIRE-WOUND CHIP INDUCTOR

(75) Inventors: Yoshio Hanato, Sabae; Tetsuya Morinaga, Fukui, both of (JP)

(73) Assignee: Murata Manufacturing, Co., LTD, Kyoto (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/164,712

(22) Filed: Oct. 1, 1998

(30) Foreign Application Priority Data

Oct. 6, 1997 (JP) ..... 9-272333

(51) Int. Cl.[7] ..... H01F 27/30; H01F 27/02

(52) U.S. Cl. ..... 336/185; 336/96; 336/90

(58) Field of Search ..... 336/90, 96, 185

(56) References Cited

U.S. PATENT DOCUMENTS

| | | | | |
|---|---|---|---|---|
| 4,586,016 | * | 4/1986 | Rilly et al. | 336/96 |
| 4,595,901 | * | 6/1986 | Yahagi | 336/192 |
| 5,764,126 | * | 6/1998 | Kanetaka et al. | 336/96 |
| 5,831,505 | * | 9/1997 | Yamaguchi et al. | 336/198 |
| 5,844,459 | * | 9/1997 | Larsen | 336/92 |

* cited by examiner

*Primary Examiner*—Anh Mai
(74) *Attorney, Agent, or Firm*—Keating & Bennett, LLP

(57) ABSTRACT

A wire-wound chip inductor includes a wire holding member having a core portion with a wire wound therearound and flange portions extending from both ends of the core portion in the axial direction, and a magnetic plate attached to the wire holding member to connect the flange portions. The width of the core portion and the width of the flange portions are substantially equal to each other, and the width of the magnetic plate is larger than the widths of the core portion and the flange portions. Preferably, the width of the magnetic plate is larger than the width of the outer form of the wire, and the magnetic plate has a pair of side wall portions extending from both widthwise ends thereof so as to sandwich the flange portions.

21 Claims, 6 Drawing Sheets

WIRE-WOUND CHIP INDUCTOR

BACKGROUND OF THE INVENTION

1. Field of the Invention

The present invention relates to a wire-wound chip inductor, and more particularly, to a wire-wound chip inductor in which a magnetic plate for increasing inductance is attached to a member for holding a wire.

2. Description of the Related Art

FIGS. 7 and 8 show a first example of a conventional wire-wound chip inductor.

A wire-wound chip inductor 1 shown in FIGS. 7 and 8 comprises a wire holding member 6 having a core portion 3 with a wire 2 wound therearound, and flange portions 4 and 5 projecting from both ends of the core portion 3 in the axial direction, and a magnetic plate 7 attached to the wire holding member 6 to connect the flange portions 4 and 5 thereto.

The above elements of the wire-wound chip inductor 1 have respective widths extending in the same direction, which direction intersects the axial direction of the core portion 3. Specifically, the outer periphery of the wire 2 has a width W1, the core portion 3 has a width W2, the flange portions 4 and 5 have a width W3, and the magnetic plate 7 has a width W4, as shown in FIGS. 7 and 8.

The width W2 of the core portion 3, the width W3 of the flange portions 4 and 5, and the width W4 of the magnetic plate 7 are equal to each other. Therefore, the width W1 of the outer form of the wire 2 is larger than these widths W2, W3, and W4.

FIGS. 9 and 10 show a second example of a conventional wire-wound chip inductor.

Similarly to the conventional wire-wound chip inductor 1 described above, a wire-wound chip inductor 11 shown in FIGS. 9 and 10 comprises a wire 12, a core portion 13, flange portions 14 and 15, a wire holding member 16, and a magnetic plate 17. The outer periphery of the wire 12 has a width W1, the core portion 13 has a width W2, the flange portions 14 and 15 have a width W3, and the magnetic plate 17 has a width W4.

While the width W3 of the flange portions 14 and 15 and the width W4 of the magnetic plate 17 are equal to each other in the wire-wound chip inductor 11, the width W2 of the core portion 13 is smaller than the width W3 of the flange portions 14 and 15, which is different from the wire-wound chip inductor 1 described above. Therefore, the width W1 of the outer periphery of the wire 12 can be made smaller than the width W3 of the flange portions 14 and 15 and the width W4 of the magnetic plate 17.

In the wire-wound chip inductor 1 shown in FIGS. 7 and 8, as mentioned above, the width W2 of the core portion 3, the width W3 of the flange portions 4 and 5, and the width W4 of the magnetic plate 7 are equal. Therefore, the widths W2 to W4 define the outer periphery of the entire wire-wound chip inductor 1. In other words, the width W2 of the core portion 3 is equal to the outermost width of the wire-wound chip inductor 1. When the width W2 of the core portion 3 is large enough to be equal to the outermost width of the wire-wound chip inductor 1, however, the length of one turn of the wire 2 increases, and a relatively large amount of stray capacitance thereby arises between adjacent portions of the wire 2. This deteriorates the characteristics at high frequencies.

Moreover, since the width W1 of the outer periphery of the wire 2 is larger than the width W3 of the flange portions 4 and 5 or the width W4 of the magnetic plate 7, when the wire-wound chip inductor 1 is handled via a chuck or the like in mounting or in other situations, the wire 2 is prone to be scratched. For this reason, an insulating coating on the wire 2 may be undesirably stripped or the wire 2 may be broken.

On the other hand, according to the wire-wound chip inductor 11 shown in FIGS. 9 and 10, since the width W2 of the core portion 13 is smaller than the width W3 of the flange portions 14 and 15, namely, the outermost width of the wire-wound chip inductor 11, as mentioned above, the stray capacitance between adjacent portions of wire can be reduced. In addition, since the width W1 of the outer periphery of the wire 12 can be made smaller than the width W3 of the flange portions 14 and 15 or the width W4 of the magnetic plate 17, it is possible to solve the problem of the wire 12 being scratched during handling of the wire-wound chip inductor 11.

In the wire-wound chip inductor 11, however, since the width W2 of the core portion 13 is smaller than the width W3 of the flange portions 14 and 15, the process of forming the wire holding member 16 including the core portion 13 and the flange portions 14 and 15 is complicated, which increases the manufacturing cost.

SUMMARY OF THE INVENTION

In order to overcome the problems described above, the preferred embodiments of the present invention provide a wire-wound chip inductor that is constructed to avoid damage to the wire, stray capacitance and increased manufacturing costs experienced with conventional inductors.

According to a preferred embodiment of the present invention, there is provided a wire-wound chip inductor including a wire holding member having a core portion with a wire wound therearound and flange portions extending from both ends of the core portion in an axial direction, and a magnetic plate attached to the wire holding member to connect the flange portions, wherein an outer periphery of the wire, the core portion, the flange portions, and the magnetic plate have respective widths measured in a common direction.

In order to solve the problems experienced by conventional devices as described above, the widths of the elements of the wire-wound chip inductor have the following relationships.

More specifically, the width of the core portion and the width of the flange portions are substantially equal to each other, and the width of the magnetic plate is larger than the widths of the core portion and the flange portions.

Preferably, the width of the magnetic plate is larger than the width of the outer periphery of the wire.

Also, it is preferred that the magnetic plate has a pair of side wall portions extending from both widthwise ends thereof so as to sandwich the flange portions. More preferably, the pair of side wall portions extend such that they cover the wire.

Further objects, features and advantages of the present invention will become apparent from the following description of preferred embodiments with reference to the attached drawings.

DETAILED DESCRIPTION OF PREFERRED EMBODIMENTS

Figure 1:
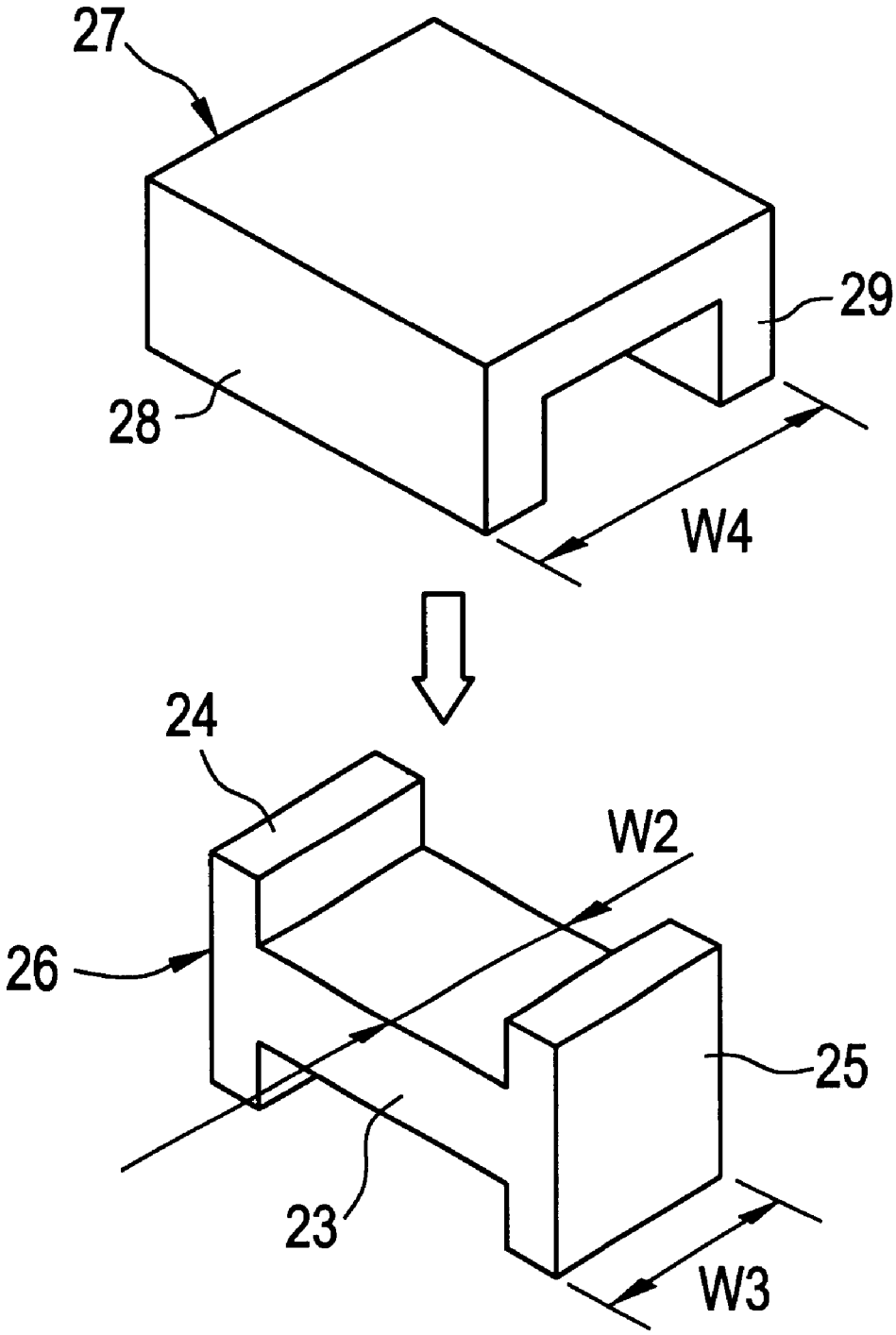
FIG. 1 is a perspective view separately showing a wire holding member and a magnetic plate of a wire-wound chip inductor according to a first preferred embodiment of the present invention.
Figure 2:
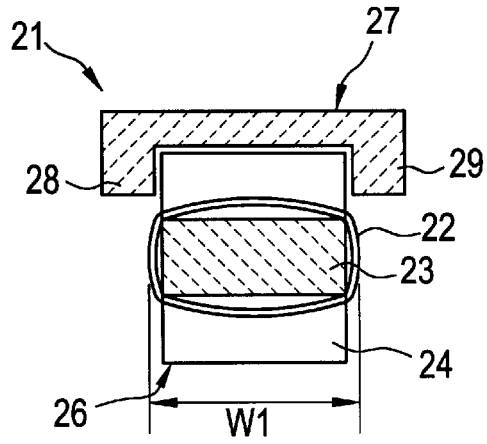
FIG. 2 is a cross-sectional view of a wire-wound chip inductor including the wire holding member and the magnetic plate shown in FIG. 1.

FIGS. 1 and 2 show a wire-wound chip inductor according to a first preferred embodiment of the present invention.

Similar to the conventional wire-wound chip inductors 1 and 11 described with reference to FIGS. 7 to 10, a wire-wound chip inductor 21 shown in FIGS. 1 and 2 comprises a wire holding member 26 having a core portion 23 with a wire 22 wound therearound, and flange portions 24 and 25 projecting from both ends of the core portion 23 in the axial direction, and a magnetic plate 27 attached to the wire holding member 26 to connect the flange portions 24 and 25.

While the wire holding member 26 of FIG. 1 is preferably made of an electrical insulating material such as a resin, the wire holding member 26 may also be made of a magnetic material in order to further increase the inductance. The magnetic plate 27 is constructed to form a closed magnetic path in the wire-wound chip inductor 21 to thereby yield a significantly larger inductance. The magnetic plate 27 is preferably made of a magnetic material such as ferrite, and fixed to the flange portions 24 and 25 via, for example, a thermosetting adhesive. At the lower ends of the flange portions 24 and 25, for example, terminal electrodes, which are not shown, are provided to function as terminals in mounting the wire-wound chip inductor 21 on a circuit substrate while connecting ends of the wire 22 thereto.

The elements of the wire-wound chip inductor 21 have respective widths that are measured in the same direction, which direction intersects the axial direction of the core portion 23. That is, the outer periphery of the wire 22 has a width W1, the core portion 23 has a width W2, the flange portions 24 and 25 have a width W3, and the magnetic plate 27 has a width W4.

Regarding these widths W1 to W4 in the wire-wound chip inductor 21, the width W2 of the core portion 23 and the width W3 of the flange portions 24 and 25 are preferably substantially equal, and the width W4 of the magnetic plate 27 is larger than the width W2 of the core portion 23 and the width W3 of the flange portions 24 and 25. Preferably, the width W4 of the magnetic plate 27 is larger than the width W1 of the outer periphery of the wire 22.

The magnetic plate 27 extends downwardly from both widthwise ends thereof to form a pair of side wall portions 28 and 29 which are arranged so as to sandwich the flange portions 24 and 25.

According to such a wire-wound chip inductor 21, the width W4 of the magnetic plate 27 defines an outer periphery of the entire wire-wound chip inductor 21. Since the width W2 of the core portion 23 is smaller than that of the outer periphery of the wire-wound chip inductor 21, it is possible to reduce the stray capacitance generated between adjacent portions of the wire 22.

As mentioned above, while the width W2 of the core portion 23 is made small, it is set to be substantially equal to the width W3 of the flange portions 24 and 25. Therefore, the process of forming the wire holding portion 26 is not complicated.

Since the width W4 of the magnetic plate 27 is larger than the width W1 of the outer periphery of the wire 22, the magnetic plate 27 protects the wire 22.

As mentioned above, the width W4 of the magnetic plate 27 defines the outer periphery of the entire wire-wound chip inductor 21. Therefore, when the width W4 of the magnetic plate 27 is set to be substantially equal to the width W4 of the magnetic plate 7 or 17 in the conventional wire-wound chip inductor 1 or 11, the advantages mentioned above can be obtained without specially changing the external dimensions of the entire wire-wound chip inductor 21.

In this preferred embodiment, the side wall portions 28 and 29 of the magnetic plate 27 extend to sandwich the flange portions 24 and 25. Therefore, the decrease in inductance, which is caused by reducing the width W2 of the core portion 23 as mentioned above, is compensated for and prevented by the side wall portions 28 and 29.

Figure 3:
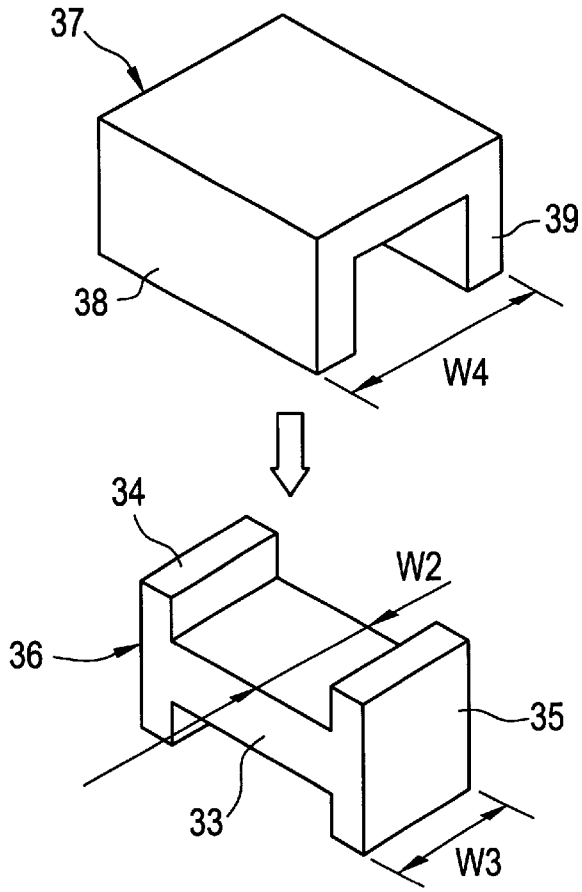
FIG. 3 is a perspective view separately showing a wire holding member and a magnetic plate of a wire-wound chip inductor according to a second preferred embodiment of the present invention.
Figure 4:
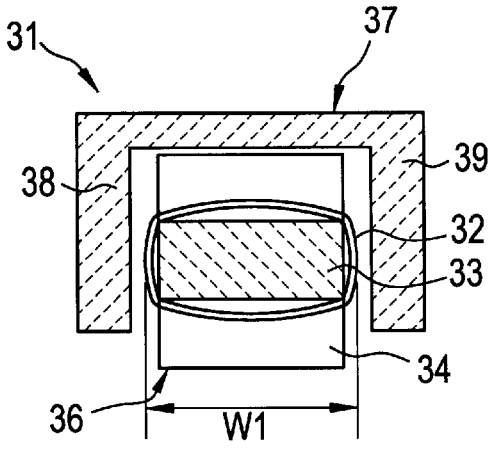
FIG. 4 is a cross-sectional view of a wire-wound chip inductor including the wire holding member and the magnetic plate shown in FIG. 3.

FIGS. 3 and 4 show a wire-wound chip inductor according to a second preferred embodiment of the present invention.

A wire-wound chip inductor 31 of the second preferred embodiment includes a wire holding member 36 having a wire 32, a core portion 33 with the wire 32 wound therearound, and flange portions 34 and 35, and a magnetic plate 37 attached to the wire holding member 36, in a similar manner to the wire-wound chip inductor 21 according to the above-described first preferred embodiment.

The outer periphery of the wire 32 has a width W1, the core portion 33 has a width W2, the flange portions 34 and 35 have a width W3, and the magnetic plate 37 has a width W4. Regarding these widths W1 to W4, similar to the wire-wound chip inductor 21 of the first preferred embodiment, the width W2 of the core portion 33 and the width W3 of the flange portions 34 and 35 are preferably substantially equal, and the width W4 of the magnetic plate 37 is preferably larger than the width W2 of the core portion 33 and the width W3 of the flange portions 34 and 35. The width W4 of the magnetic plate 37 is also preferably larger than the width W1 of the outer periphery of the wire 32.

Therefore, the wire-wound chip inductor 31 of the second preferred embodiment provides advantages that are substantially similar to those achieved by the wire-wound chip inductor 21 of the first preferred embodiment.

The structure of the wire-wound chip inductor 31 according to the second preferred embodiment is characterized in that a pair of side wall portions 38 and 39 for sandwiching the flange portions 34 and 35 extend from both widthwise ends of the magnetic plate 37 to positions such that they completely cover the wire 32 at three sides thereof. This structure makes it possible to further improve the function of the magnetic plate 37 for protecting the wire 32, and the function of the side wall portions 38 and 39 for compensating for the decrease in inductance due to the reduction in the width W2 of the core portion 33.

Although not shown, the lower surface of the magnetic plate 37 may have a recess for receiving the upper surfaces of the flange portions 34 and 35 to accurately position the magnetic plate 37 and the wire holding member 36. This also applies to the first preferred embodiment mentioned above.

Figure 5:
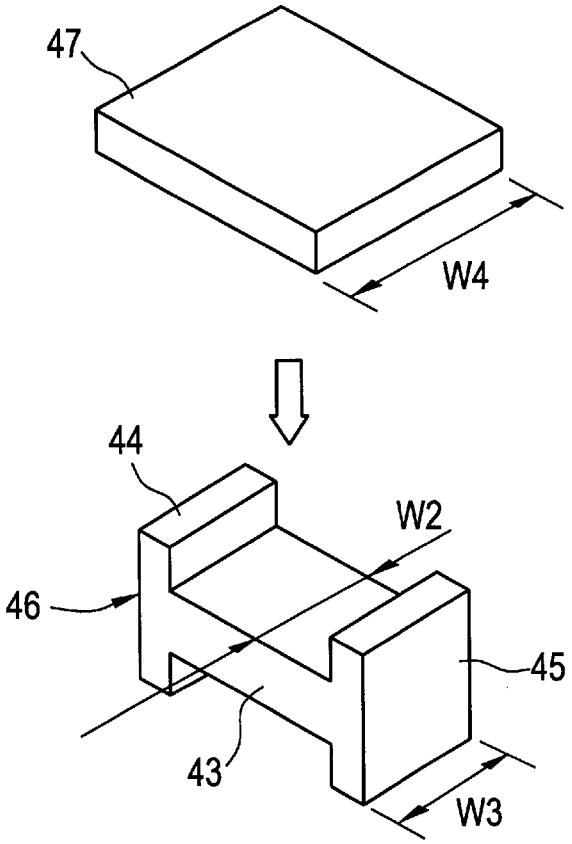
FIG. 5 is a perspective view separately showing a wire holding member and a magnetic plate of a wire-wound chip inductor according to a third preferred embodiment of the present invention.
Figure 6:
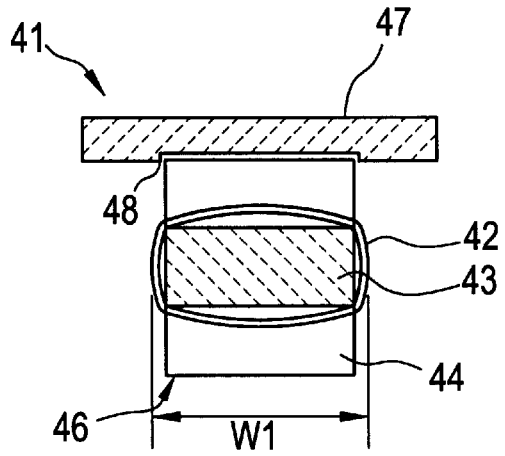
FIG. 6 is a cross-sectional view of a wire-wound chip inductor including the wire holding member and the magnetic plate shown in FIG. 5.
Figure 7:
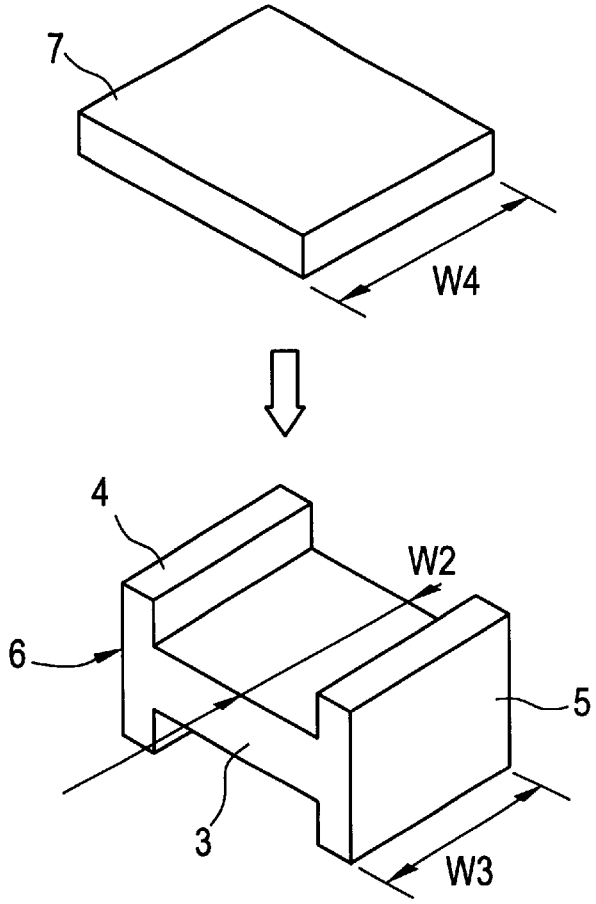
FIG. 7 PRIOR ART
FIG. 7 is a perspective view separately showing a wire holding member and a magnetic plate of a first example of a conventional wire-wound chip inductor.
Figure 8:
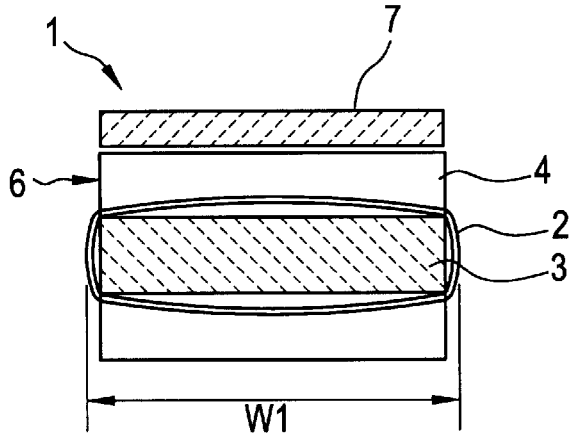
FIG. 8 PRIOR ART
FIG. 8 is a cross-sectional view of a first example of a conventional wire-wound chip inductor including the wire holding member and the magnetic plate shown in FIG. 7.
Figure 9:
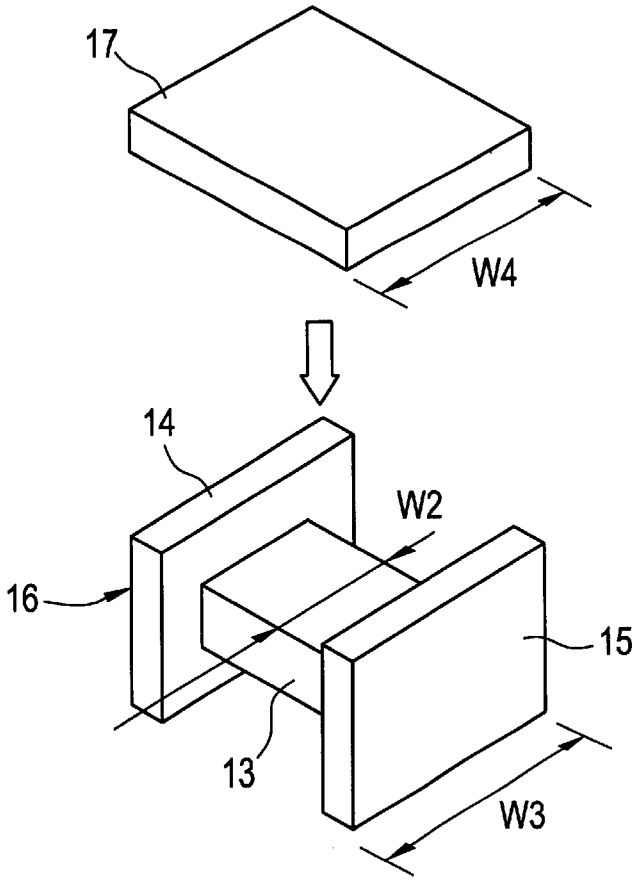
FIG. 9 PRIOR ART
FIG. 9 is a perspective view separately showing a wire holding member and a magnetic plate of a second example of a conventional wire-wound chip inductor.
Figure 10:
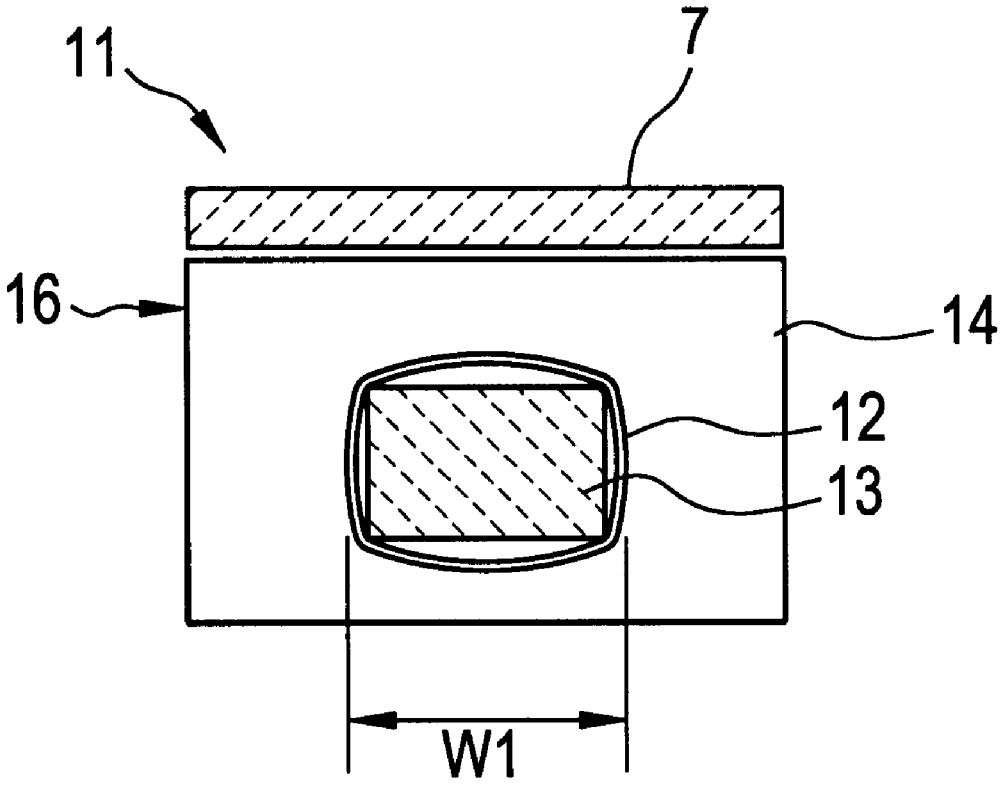
FIG. 10 PRIOR ART
FIG. 10 is a cross-sectional view of a second example of a wire-wound chip inductor including the wire holding member and the magnetic plate shown in FIG. 9.

FIGS. 5 and 6 show a wire-wound chip inductor according to a third preferred embodiment of the present invention.

A wire-wound chip inductor 41 of the third preferred embodiment includes a wire holding member 46 having a wire 42, a core portion 43 with the wire 42 wound therearound, and flange portions 44 and 45, and a magnetic plate 47 attached to the wire holding member 46, in a manner similar to the wire-wound chip inductor 21 of the first preferred embodiment or the wire-wound chip inductor 31 of the second preferred embodiment mentioned above.

The outer periphery of the wire 42 has a width W1, the core portion 43 has a width W2, the flange portions 44 and 45 have a width W3, and the magnetic plate 47 has a width W4. Regarding these widths W1 to W4, similar to the wire-wound chip inductor 21 of the first preferred embodiment or the wire-wound chip inductor 31 of the second preferred embodiment, the width W2 of the core portion 43 and the width W3 of the flange portions 44 and 45 are preferably substantially equal, and the width W4 of the magnetic plate 47 is preferably larger than the width W2 of the core portion 43 and the width W3 of the flange portions 44 and 45. The width W4 of the magnetic plate 47 is also preferably larger than the width W1 of the outer periphery of the wire 42.

Therefore, the wire-wound chip inductor 41 of the third preferred embodiment provides advantages that are substantially similar to the advantages achieved by the wire-wound chip inductor 21 of the first preferred embodiment.

The structure of the wire-wound chip inductor 41 according to the third preferred embodiment is characterized in that the magnetic plate 47 does not have side wall portions like the side wall portions 28 and 29 shown in FIG. 1 and has a flat plate configuration. The magnetic plate 47 thus shaped like a flat plate also protects the wire 42.

The lower surface of the magnetic plate 47 has a recess 48 for receiving the upper surfaces of the flange portions 44 and 45 to accurately position the magnetic plate 47 and the wire holding member 46.

While the present invention has been described with reference to the illustrated embodiments, it is to be understood that the invention is not limited to the disclosed preferred embodiments. On the contrary, the invention is intended to cover various modifications and equivalent arrangements included within the spirit and scope of the appended claims.

For example, while the illustrated core portions 23, 33, and 43 have a substantially rectangular cross section, the core portions may have a cross section of other shapes, such as a circle and an ellipse.

The magnetic plate 27, 37, or 47 may be placed on both sides of the wire holding member 26, 36, or 46 instead of being placed on only one side thereof.

As mentioned above, according to preferred embodiments of the present invention, the width of the core portion in the wire holding member and the width of the flange portions are substantially equal to each other, and the width of the magnetic plate, which is attached to the core portion to link the flange portions, is larger than the widths of the core portion and the flange portions. Therefore, the width of the magnetic plate defines the outer periphery of the entire wire-wound chip inductor, and the width of the core portion is smaller than that of the outer periphery of the wire-wound chip inductor. This makes it possible to reduce the stray capacitance generated between adjacent portions of the wire, and to thereby improve the high-frequency characteristics of the wire-wound chip inductor.

As mentioned above, since the width of the flange portions is substantially equal to the width of the core portion while the width of the core portion is reduced, the process for forming the wire holding member is not complicated. This avoids increases in the manufacturing cost of the wire holding member and the wire-wound chip inductor.

In preferred embodiments of the present invention, when the width of the magnetic plate is larger than the width of the outer periphery of the wire, the magnetic plate protects the wire. Therefore, it is possible to prevent the wire-wound chip inductor from being seriously damaged due to the stripping of an insulating coating on the wire or the breaking of the wire.

When the magnetic plate has a pair of side wall portions extending from both widthwise ends thereof so as to sandwich the flange portions, the decrease in inductance due to the reduction in width of the core portion can be advantageously compensated for by these side wall portions.

When the aforesaid pair of side wall portions extend to such positions so as to cover the wire, it is possible to further improve the function of the magnetic plate for protecting the wire, and to further improve the function of the side wall portions for compensating for the decrease in inductance due to the reduction in width of the core portion.

What is claimed is:

1. A wire-wound chip inductor, comprising:

a wire holding member having a core portion with a wire wound therearound, and flange portions extending from both ends of said core portion, the wire holding member including the core portion and the flange portion all being formed completely of magnetic material, and the wire holding member being a single unitary member; and a magnetic plate attached to said wire holding member to connect said flange portions; wherein an outer periphery of said wire wound around said core portion, said core portion, said flange portions, and said magnetic plate have respective widths measured in a direction perpendicular to a longitudinal axis of the wire-wound chip inductor, the width of said core portion and the width of said flange portions are substantially equal to each other, and the width of said magnetic plate is larger than the widths of said core portion and said flange portion.

2. A wire-wound chip inductor according to claim 1, wherein the width of said magnetic plate is larger than the width of the outer periphery of said wire wound around said core portion.

3. A wire-wound chip inductor according to claim 1, wherein said magnetic plate has a pair of side wall portions extending from ends thereof so as to sandwich said flange portions.

4. A wire-wound chip inductor according to claim 3, wherein said pair of side wall portions extend such that said side wall portions of said magnetic plate partially cover said wire on said wire holding member at two opposite side surfaces thereof.

5. A wire-wound chip inductor according to claim 3, wherein said pair of side wall portions extend such that said side wall portions of said magnetic plate completely cover said wire on said wire holding member at two opposite side surfaces thereof.

6. A wire-wound chip inductor according to claim 3, wherein the width of said magnetic plate defines an outer periphery of the wire-wound chip inductor.

7. A wire-wound chip inductor according to claim 1, wherein the magnetic plate has a substantially U-shaped configuration.

8. A wire-wound chip inductor according to claim 7, wherein a portion of said wire holding member fits within said U-shaped configuration of said magnetic plate.

9. A wire-wound chip inductor according to claim 1, wherein an upper interior surface of said magnetic plate includes a recess for receiving an upper surface of the wire holding member.

10. A wire chip inductor, comprising:

a wire holding member having a unitary core portion that is completely magnetic with a wire wound around only the completely magnetic unitary core portion, and flange portions extending from both ends of said core portion; and a magnetic plate attached to said wire holding member to connect said flange portions; wherein the magnetic plate partially surrounds the wire holding member on at least two sides of said wire holding member and an outer periphery of the magnetic plate alone defines an outer periphery of the wire-wound chip inductor.

11. A wire-wound chip inductor according to claim 10, wherein the magnetic plate has a substantially U-shaped configuration.

12. A wire-wound chip inductor according to claim 11, wherein a portion of said wire holding member fits within said U-shaped configuration of said magnetic plate.

13. A wire-wound chip inductor according to claim 10, wherein an upper interior surface of said magnetic plate includes a recess for receiving an upper surface of the wire holding member.

14. A wire-wound chip inductor according to claim 10, wherein an outer periphery of said wire wound around said core portion, said core portion, said flange portion, and said magnetic plate have respective widths measured in a direction perpendicular to a longitudinal axis of the wire-wound inductor, the width of said core portion and the width of said flange portions are substantially equal to each other, and the width of said magnetic plate is larger than the widths of said core portion and said flange portions.

15. A wire-wound chip inductor according to claim 14, wherein the width of said magnetic plate is larger than the width of the outer periphery of said wire wound around said core portion.

16. A wire-wound chip inductor according to claim 10, wherein said magnetic plate has a pair of side wall portions extending from ends thereof so as to sandwich said flange portions.

17. A wire-wound chip inductor according to claim 16, wherein said pair of side wall portions extend such that said side wall portions of said magnetic plate partially cover said wire on said wire holding member at two opposite side surfaces thereof.

18. A wire-wound chip inductor according to claim 16, wherein said pair of side wall portions extend such that said side wall portions of said magnetic plate completely cover said wire on said wire holding member at two opposite side surfaces thereof.

19. A wire chip inductor, comprising:

a wire holding member having a unitary core portion that is completely magnetic with a wire wound around only the completely magnetic unitary core portion, and flange portions extending from both ends of said core portion; and a magnetic plate attached to said wire holding member to connect said flange portions; wherein the magnetic plate has a substantially U-shaped configuration and a portion of said wire holding member fits within said U-shaped configuration of said magnetic plate.

20. A wire-wound chip inductor according to claim 19, wherein an outer periphery of said wire wound around said core portion, said core portion, said flange portion, and said magnetic plate have respective widths measured in a direction perpendicular to a longitudinal axis of the wire-wound inductor, the width of said core portion and the width of said flange portions are substantially equal to each other, and the width of said magnetic plate is larger than the widths of said core portion and said flange portions.

21. A wire-wound chip inductor according to claim 19, wherein said magnetic plate has a pair of side wall portions extending from ends thereof so as to sandwich said flange portions.

* * * * *